United States Patent [19]

Suzuki et al.

[11] Patent Number: 4,513,481

[45] Date of Patent: Apr. 30, 1985

[54] EASILY DISPLACEABLE BOTTOM TENSER

[75] Inventors: Yoshihisa Suzuki, Chiryu; Yoshiharu Yasui, Toyota; Kazuo Seiki, Kariya; Shigeru Takasu, Nishio, all of Japan

[73] Assignee: Kabushiki Kaisha Toyoda Jidoshokki Seisakusho, Aichi, Japan

[21] Appl. No.: 523,953

[22] Filed: Aug. 17, 1983

[30] Foreign Application Priority Data

Sep. 2, 1982 [JP] Japan ..... 57-151767
Sep. 8, 1982 [JP] Japan ..... 57-155111

[51] Int. Cl.[3] ..... D01H 5/86

[52] U.S. Cl. ..... 19/244; 19/250; 19/251; 19/252; 19/256

[58] Field of Search ..... 19/244, 250, 252, 253, 19/254, 255, 256, 251

[56] References Cited

U.S. PATENT DOCUMENTS 2,943,361 7/1960 Cotchett ..... 19/251
3,014,248 12/1961 Cole et al. ..... 19/252
3,195,188 7/1965 Cole ..... 19/255
3,310,845 3/1967 Pitts et al. ..... 19/255
3,404,434 10/1968 Smith ..... 19/252
4,280,252 7/1981 Shlykov et al. ..... 19/256 X

*Primary Examiner*—Louis K. Rimrodt
*Attorney, Agent, or Firm*—Burgess, Ryan and Wayne

[57] ABSTRACT

A bottom tenser utilized for a drafting means of a spinning frame, especially for fasciated yarn spinning, in which a fiber bundle is attenuated at a high speed exceeding 100 m/min. The bottom tenser as well as a bottom roller corresponding to the tenser is provided with a free end through which an apron is easily removable from and mountable on the tenser and the roller. The tenser may be constituted by a body and at least a guide wall movable relative to the body. The guide wall prevents lateral movement of the apron in its operative position and, in turn, is displaced or removed from the body in its non-operative position so as not to obstruct an apron exchanging operation.

10 Claims, 24 Drawing Figures

Figure 1:
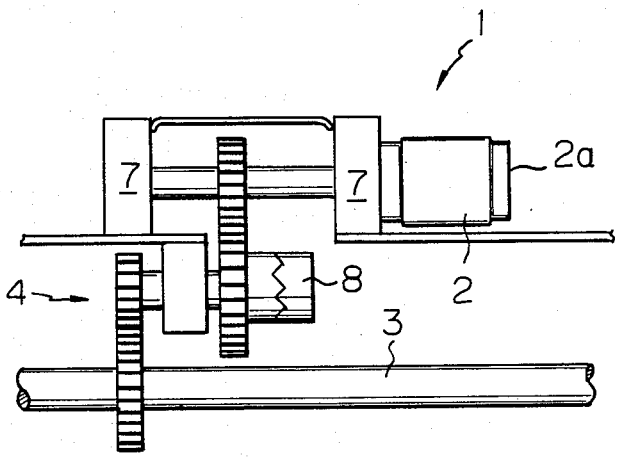
Figure 2:
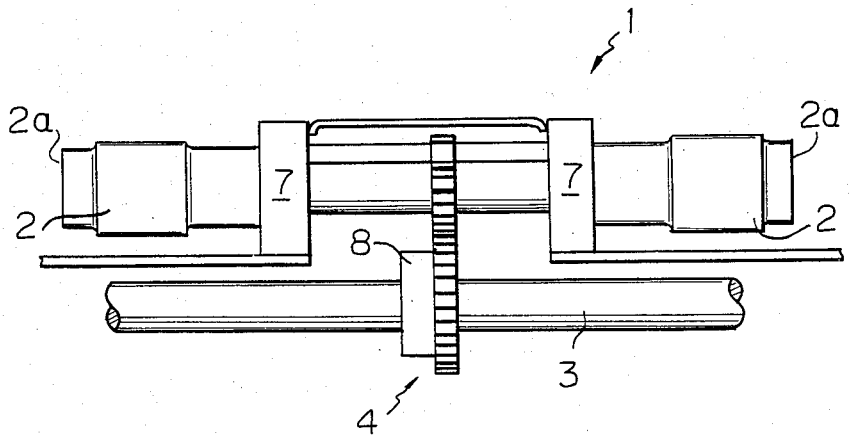
Figure 3:
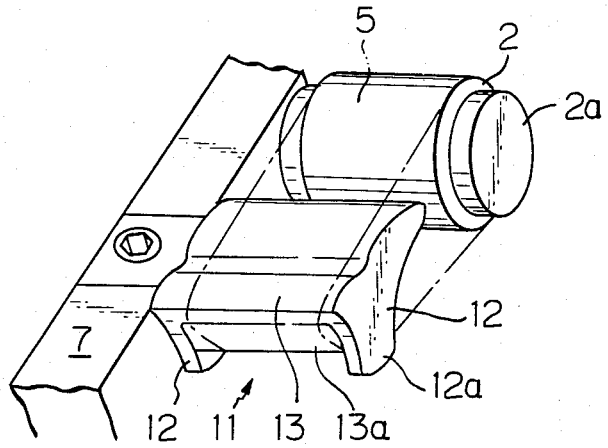
Figure 4A:
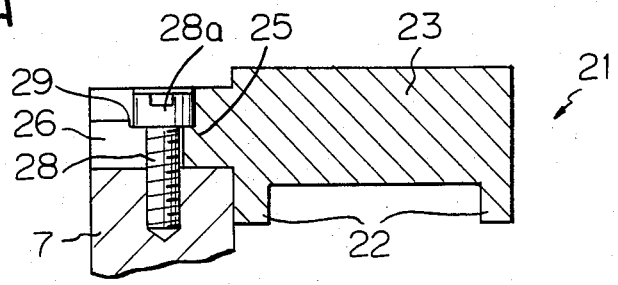
Figure 4B:
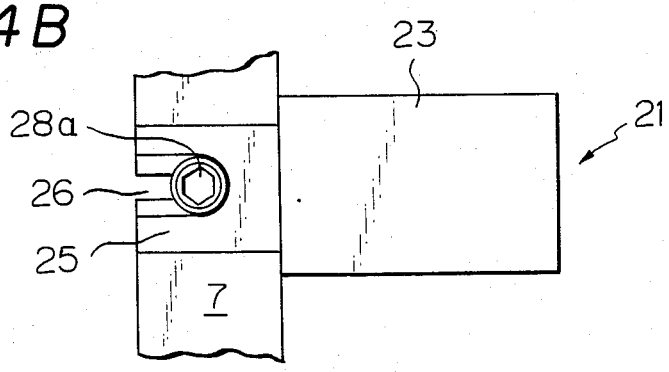
Figure 6:
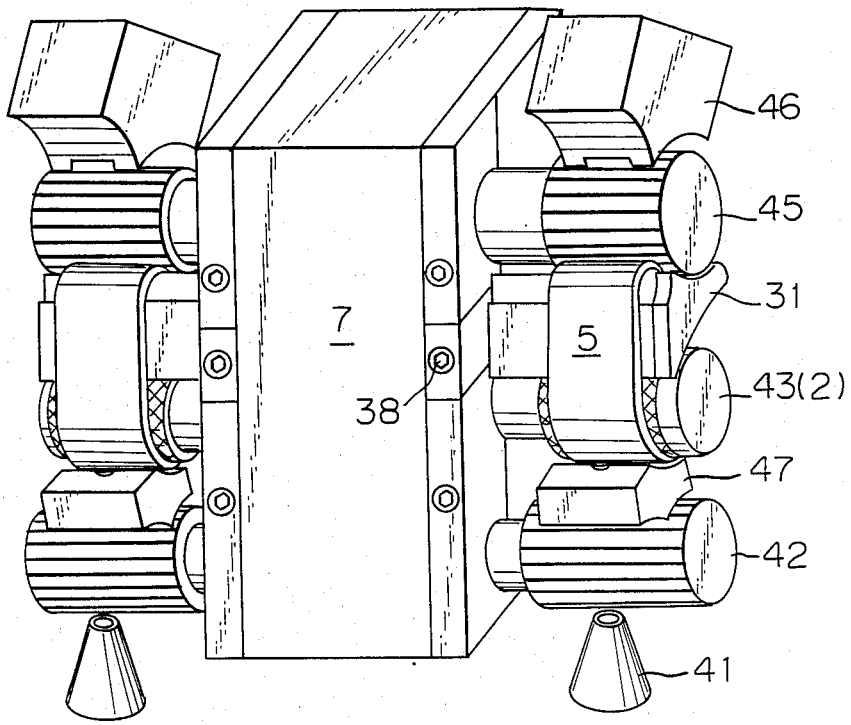
Figure 7A:
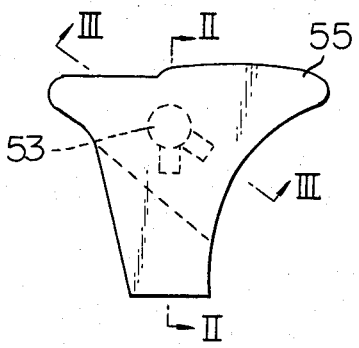
Figure 7B:
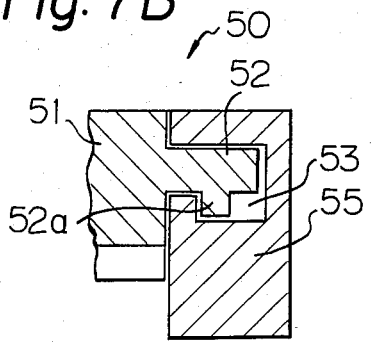
Figure 7C:
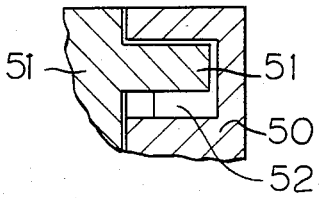
Figure 7D:
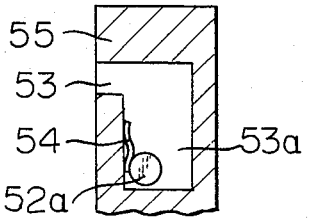

Fig. 5B
Fig. 5A
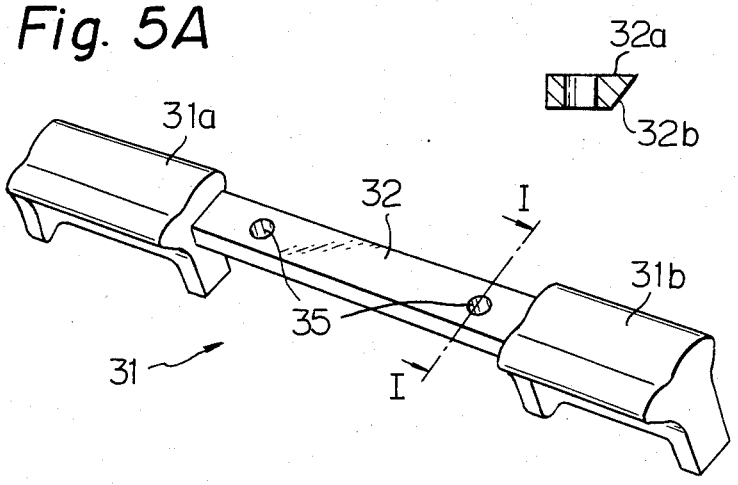
Fig. 5 C
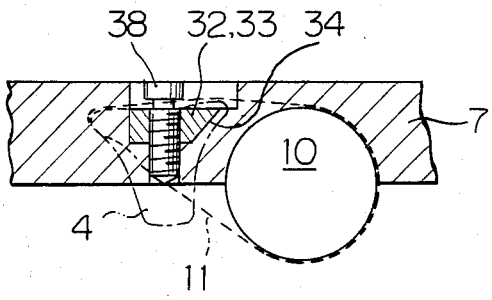

dismounted from or mounted on the tenser while the latter is fixed on the stand.

In FIGS. 7A through 7D, a third embodiment is illustrated. At an outer end of a body 51 of a tenser 50 is projected a key-shaped cylindrical pin 52 with a projection 52*a* on the circumference thereof. At the corresponding position of a guide wall 55 is provided a keyhole 53 to receive the pin 52. The body 51 is assembled with the guide wall 55 by engaging the pin 52 to the hole 53 and, thereafter, by rotating the guide wall 55 in a predetermined angle about the axis of the pin 52 until the projection 52*a* is held by a spring 54 provided in the innermost portion 53*a* of the hole 53. This constitutes the operative position. To dismount the guide wall 55, the guide wall 55 is twisted reversely from the above-stated mounting operation with a torque enabling the projection 52*a* to overcome the force of the spring 54 until the projection 52*a* is aligned with the hole 53. In this state, the wall 55 is easily removable from the body 51.

Figure 8A:
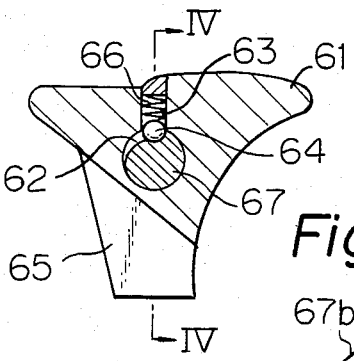
Figure 8B:
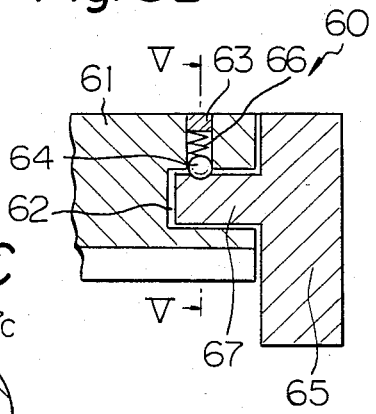
Figure 8C:
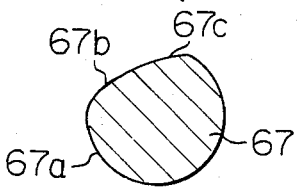

A fourth embodiment is illustrated in FIGS. 8A through 8C, in which a body 61 of a tenser 60 is provided with a cylindrical hole 62 at a center of an outer end thereof and an aperture 63 bored perpendicularly to the hole 62 through a top wall of the body 61. A ball 64 is accommodated in the aperture 63 and is urged into the hole 62 by means of a spring 66. On the other hand, a guide wall 65 has a pin 67 projected from an inner wall thereof at a position corresponding to the hole 62. The pin 67 has an irregularly shaped cross-section at least in part thereof and can be mated with the hole 62. The irregularly-shaped cross-section of the pin 67 constitutes a half circle 67*a* of the same diameter as the cross-section of the hole 62, an arc 67*b* of a smaller diameter than the latter, and, in a selected area of the circumference of the pin 67 corresponding to the position of the aperture 63 when engaged, a concave arc 67*c* to accommodate part of the ball 64.

For assembly, the pin 67 is pushed into the hole 62, taking care that the arc 67*b* meets with the ball 64 by referring to suitable marks (not shown) on the body 61 and the pin 67. When the pin 67 reaches the ball 64, it therefore pushes the ball 64 back into the aperture 63. The pin 67 can then easily be inserted completely into the hole 62 to reach the innermost portion of the hole 62. The pin 67 is then rotated by twisting the guide wall 65 so that the ball 64 fits into the concave arc 67*c*. The guide wall 65 is thus fixed to the body 61 by the force of the spring 66 and is maintained in the operative position. Of course, the operation of dismounting the guide wall from the body can be carried out by following the above operation in reverse.

Figure 9A:
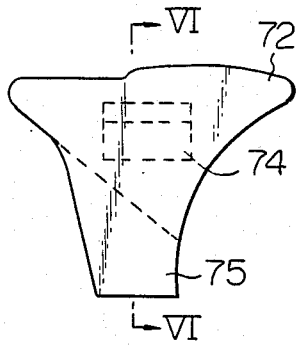
Figure 9B:
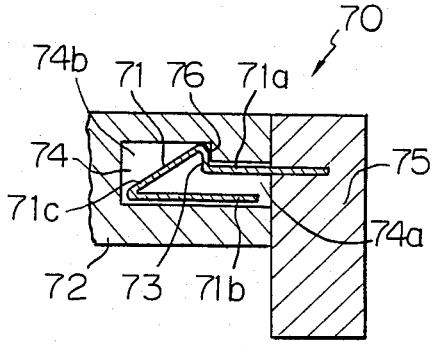
Figure 10A:
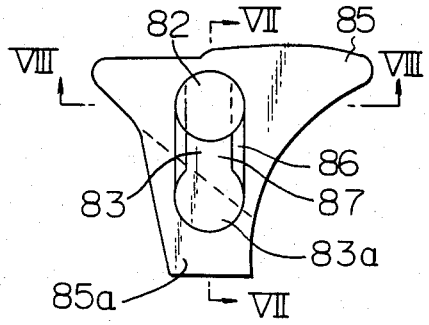
Figure 10B:
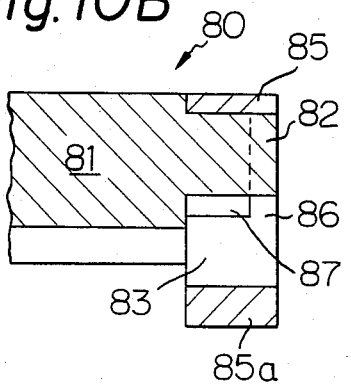
Figure 10C:
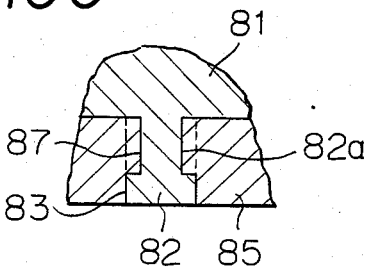
Figure 10D:
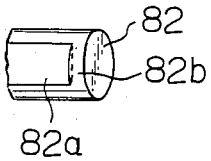

A fifth embodiment is illustrated in FIGS. 9A and 9B, in which a guide wall 75 of a tenser 70 has an insert 71 perpendicularly projected from a surface thereof facing the body 72. The insert 71 is constituted by upper and lower plates 71*a* and 71*b* which are formed by folding a strip of resilient material such as spring steel. The rear end of the upper plate 71*a* is embedded in the guide wall 75 and the rear end of the lower plate 71*b* is free. The front portion of the upper plate 71*a* forms a tapered nose 71*c* mating with the lower plate 71*b* and the rear portion thereof is flat. At a border between the front and rear portion of the upper plate 71*a* is provided a step 73, the height of which is less than that of the tapered nose 71*c*. According to this structure, the thickness of the insert 71 is variable by pressing the lower plate 71*b* toward the upper plate 71*a*. On the other hand, the body 72 has, on an outer end thereof, a slit 74 of a rectangular cross-section to receive the insert 71. The height of the slit 14 is larger in an inner part 74*b* thereof than in an inlet part 74*a*, whereby a step 76 is formed between the two parts.

For assembly, the insert 71 of the guide wall 75 is pushed into the inlet part 74*a* of the slit 74 of the body 72. The tapered nose 71*c* deforms resiliently so that the height of the step 73 matches that of the inlet part 74*a*. After passing the step 76, the tapered nose 71*c* returns to its original height. Thus, the guide wall 75 is fixed in its operative position by engagement of the step 73 with the step 76. For removal, the guide wall 75 is slid downward relative to the body 72 so that the nose is decreased in thickness thereof and disengages from the step 76. The guide wall 75 is then pulled out of the body 72.

In FIGS. 10A through 10D is illustrated a sixth embodiment. A body 81 of a tenser 80 has a cylindrical projection 82 on an outer end surface facing a guide wall 85. The projection 82 has two parallel plain surfaces 82*a* on opposite sides of a stem thereof except for a tip portion 82*b*. The distance between the plain surfaces 82*a* is less than the diameter of the tip portion 82*b*. In turn, the guide wall 85 has an elongated through-hole 83 extending along a longitudinal axis of the guide wall 85. The through-hole 83 is of a double layer structure. An inner layer 87 has a keyhole configuration, while an outer layer 86 has a "race track" configuration. The layers 86 and 87 adjoin each other so that the circular portion of the layer 86 coincides with the circular portion of layer 87 and straight portions thereof overlap. The above coinciding circular portions are disposed at the lowermost end of the hole 83 and constitute an inlet aperture 83*a*. The inlet aperture 83*a* has the same diameter as the tip portion of the projection 82. The widths of the straight portions of the outer and inner layers 86, 87 are substantially the same as the diameter of the tip portion 82*b* and the thickness of the stem portion 82*a* of the projection 82, respectively. The depths of the outer and inner layers are substantially the same as the heights of the tip portion and the stem portion, respectively.

According to the above structure, for assembly, the projection 82 of the body 81 is inserted into the inlet aperture 83*a* of the guide wall 85. The guide wall 85 is displaced stably along the through-hole 83 to fit stem portion 82*a* into the straight portion of the inner layer 87. After the projection 82 reaches the uppermost position of the through-hole 83, the two parts 81 and 85 are prevented from rotating with respect to each other as the stem portion 82 is held by the straight portion of the inner layer 8.

Figure 11A:
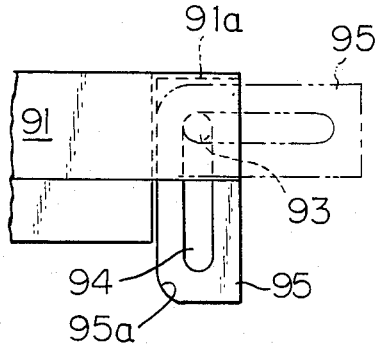
Figure 11B:
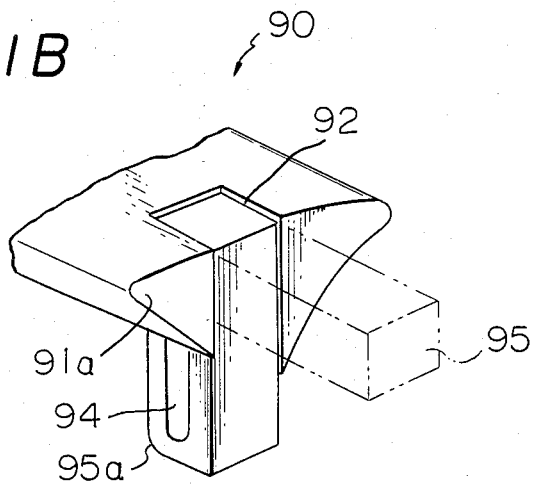

In FIGS. 11A and 11B, a seventh embodiment is illustrated. An upper half of a body 91 of a tenser 90 has a laterally extended portion 91*a*, on the outer side wall of which there is a groove 92 running from the top wall to the bottom wall. A guide wall 95 is fit in the groove 92 and is supported therein by engaging an elongated hole 94 provided along the longitudinal direction of the guide wall 95 with a pin 93 widthwisely bridging the side walls of the groove 92. In the operative position, the guide wall 95 is fixed in the groove 92 in such a manner that the uppermost end of the hole 94 is held by the pin 93 and the upper half of the guide wall 95 is in frictional contact with the side walls of the groove 92, while the lower half of the guide wall 95 is downwardly projected from the groove 92. The projected portion of the wall 95 forms a stopper for lateral movement of the apron in operation, as stated before. The guide wall 95 is upwardly slidable along the groove 92, while being guided by the pin 93 and the elongated hole 94.

When exchanging the apron, the wall 95 is slid upward so that the lowermost end of the elongated hole 94 abuts the pin 93. An inner edge 95*a* of the lowermost end of the guide wall 95 facing the body 91 has been rounded off to allow clockwise rotation when the lower end of the hole 94 reaches the pin 93. Thus, the guide wall 95 can be turned outward just at a right angle and be held in the position by engagement of the lower end thereof to the bottom of the groove 92, as shown by chain lines in FIG. 11B. As a result, the projected portion of the guide wall 95 is eliminated, making the apron easily replaceable.

As stated above, according to the first aspect of the present invention, the tenser can easily be mounted or dismounted, allowing replacement of an apron can be completed in a shorter time.

Further, according to the second aspect, as the guide wall can be displaced relative to the body of the tenser, the apron can be replaced without being obstructed by the projected portion of the tenser, while the tenser is fixed to the stand.

Thus, the machine stoppage time for a spinning frame is drastically decreased and the resultant yarn quality is improved.

We claim:

1. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means permitting movement of said guide wall member relative to said body, to said apron removal position wherein said apron may be removed from or installed on the free end of said tensioning device.

2. A tensioning device according to claim 1, wherein said connecting means is a combination of a protrusion projected in the lateral direction and a bore receiving the protrusion, each being provided at either of said body or guide wall member of said tensioning device, and said guide wall member is rotatable in a plane parallel to a side surface of said body around the axis of said connecting means from its operative position to a non-operative position.

3. A tensioning device according to claim 1, wherein said connecting means is a combination of a protrusion projected in the lateral direction and a bore receiving the protrusion, each being provided at either of said body or guide wall member of said tensioning device, and said guide wall member is detachable from said body by disengagement of said protrusion from said bore.

4. A tensioning device according to claim 1, wherein said guide wall member is received in a groove provided on a side surface of said body and held therein by engagement of an elongated through-hole of said groove with a pin provided in an upper portron of said groove for bridging inner walls of said groove, whereby said guide wall member is displaceable along said groove and is in said usage position at the lowermost displacement thereof and in said apron removal position at the uppermost displacement where said guide wall is rotatable in a plane perpendicular to a side surface of said body around said pin.

5. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means comprising a key-shaped cylindrical pin extending from said body, and a mating keyhole in said guide wall, said connecting means permitting movement of said guide wall member relative to said body, to said apron removal position wherein said apron may be removed from or installed on the free end of said tensioning device, said pin and keyhole of said connecting means cooperating to permit rotation of said guide wall member relative to said body between said usage position and said apron removal position, said guide wall member being removable from said body when said guide wall member is in the apron removal position thereof.

6. The tensioning device according to claim 5, further comprising spring means disposed within said keyhole for retaining said guide wall in said usage position.

7. A tensioning device for tensioning an apron wrapped around a cantilever-mounted bottom roller of a drafting means in a spinning frame, said roller having an outer free end on one side from which said apron may be removed, said tensioning device being adapted dismounted from or mounted on the tenser while the latter is fixed on the stand.

In FIGS. 7A through 7D, a third embodiment is illustrated. At an outer end of a body 51 of a tenser 50 is projected a key-shaped cylindrical pin 52 with a projection 52*a* on the circumference thereof. At the corresponding position of a guide wall 55 is provided a keyhole 53 to receive the pin 52. The body 51 is assembled with the guide wall 55 by engaging the pin 52 to the hole 53 and, thereafter, by rotating the guide wall 55 in a predetermined angle about the axis of the pin 52 until the projection 52*a* is held by a spring 54 provided in the innermost portion 53*a* of the hole 53. This constitutes the operative position. To dismount the guide wall 55, the guide wall 55 is twisted reversely from the above-stated mounting operation with a torque enabling the projection 52*a* to overcome the force of the spring 54 until the projection 52*a* is aligned with the hole 53. In this state, the wall 55 is easily removable from the body 51.

A fourth embodiment is illustrated in FIGS. 8A through 8C, in which a body 61 of a tenser 60 is provided with a cylindrical hole 62 at a center of an outer end thereof and an aperture 63 bored perpendicularly to the hole 62 through a top wall of the body 61. A ball 64 is accommodated in the aperture 63 and is urged into the hole 62 by means of a spring 66. On the other hand, a guide wall 65 has a pin 67 projected from an inner wall thereof at a position corresponding to the hole 62. The pin 67 has an irregularly shaped cross-section at least in part thereof and can be mated with the hole 62. The irregularly-shaped cross-section of the pin 67 constitutes a half circle 67*a* of the same diameter as the cross-section of the hole 62, an arc 67*b* of a smaller diameter than the latter, and, in a selected area of the circumference of the pin 67 corresponding to the position of the aperture 63 when engaged, a concave arc 67*c* to accommodate part of the ball 64.

For assembly, the pin 67 is pushed into the hole 62, taking care that the arc 67*b* meets with the ball 64 by referring to suitable marks (not shown) on the body 61 and the pin 67. When the pin 67 reaches the ball 64, it therefore pushes the ball 64 back into the aperture 63. The pin 67 can then easily be inserted completely into the hole 62 to reach the innermost portion of the hole 62. The pin 67 is then rotated by twisting the guide wall 65 so that the ball 64 fits into the concave arc 67*c*. The guide wall 65 is thus fixed to the body 61 by the force of the spring 66 and is maintained in the operative position. Of course, the operation of dismounting the guide wall from the body can be carried out by following the above operation in reverse.

A fifth embodiment is illustrated in FIGS. 9A and 9B, in which a guide wall 75 of a tenser 70 has an insert 71 perpendicularly projected from a surface thereof facing the body 72. The insert 71 is constituted by upper and lower plates 71*a* and 71*b* which are formed by folding a strip of resilient material such as spring steel. The rear end of the upper plate 71*a* is embedded in the guide wall 75 and the rear end of the lower plate 71*b* is free. The front portion of the upper plate 71*a* forms a tapered nose 71*c* mating with the lower plate 71*b* and the rear portion thereof is flat. At a border between the front and rear portion of the upper plate 71*a* is provided a step 73, the height of which is less than that of the tapered nose 71*c*. According to this structure, the thickness of the insert 71 is variable by pressing the lower plate 71*b* toward the upper plate 71*a*. On the other hand, the body 72 has, on an outer end thereof, a slit 74 of a rectangular cross-section to receive the insert 71. The height of the slit 14 is larger in an inner part 74*b* thereof than in an inlet part 74*a*, whereby a step 76 is formed between the two parts.

For assembly, the insert 71 of the guide wall 75 is pushed into the inlet part 74*a* of the slit 74 of the body 72. The tapered nose 71*c* deforms resiliently so that the height of the step 73 matches that of the inlet part 74*a*. After passing the step 76, the tapered nose 71*c* returns to its original height. Thus, the guide wall 75 is fixed in its operative position by engagement of the step 73 with the step 76. For removal, the guide wall 75 is slid downward relative to the body 72 so that the nose is decreased in thickness thereof and disengages from the step 76. The guide wall 75 is then pulled out of the body 72.

In FIGS. 10A through 10D is illustrated a sixth embodiment. A body 81 of a tenser 80 has a cylindrical projection 82 on an outer end surface facing a guide wall 85. The projection 82 has two parallel plain surfaces 82*a* on opposite sides of a stem thereof except for a tip portion 82*b*. The distance between the plain surfaces 82*a* is less than the diameter of the tip portion 82*b*. In turn, the guide wall 85 has an elongated through-hole 83 extending along a longitudinal axis of the guide wall 85. The through-hole 83 is of a double layer structure. An inner layer 87 has a keyhole configuration, while an outer layer 86 has a "race track" configuration. The layers 86 and 87 adjoin each other so that the circular portion of the layer 86 coincides with the circular portion of layer 87 and straight portions thereof overlap. The above coinciding circular portions are disposed at the lowermost end of the hole 83 and constitute an inlet aperture 83*a*. The inlet aperture 83*a* has the same diameter as the tip portion of the projection 82. The widths of the straight portions of the outer and inner layers 86, 87 are substantially the same as the diameter of the tip portion 82*b* and the thickness of the stem portion 82*a* of the projection 82, respectively. The depths of the outer and inner layers are substantially the same as the heights of the tip portion and the stem portion, respectively.

According to the above structure, for assembly, the projection 82 of the body 81 is inserted into the inlet aperture 83*a* of the guide wall 85. The guide wall 85 is displaced stably along the through-hole 83 to fit stem portion 82*a* into the straight portion of the inner layer 87. After the projection 82 reaches the uppermost position of the through-hole 83, the two parts 81 and 85 are prevented from rotating with respect to each other as the stem portion 82 is held by the straight portion of the inner layer 8.

In FIGS. 11A and 11B, a seventh embodiment is illustrated. An upper half of a body 91 of a tenser 90 has a laterally extended portion 91*a*, on the outer side wall of which there is a groove 92 running from the top wall to the bottom wall. A guide wall 95 is fit in the groove 92 and is supported therein by engaging an elongated hole 94 provided along the longitudinal direction of the guide wall 95 with a pin 93 widthwisely bridging the side walls of the groove 92. In the operative position, the guide wall 95 is fixed in the groove 92 in such a manner that the uppermost end of the hole 94 is held by the pin 93 and the upper half of the guide wall 95 is in frictional contact with the side walls of the groove 92, while the lower half of the guide wall 95 is downwardly projected from the groove 92. The projected portion of the wall 95 forms a stopper for lateral movement of the apron in operation, as stated before. The guide wall 95 is upwardly slidable along the groove 92, while being guided by the pin 93 and the elongated hole 94.

When exchanging the apron, the wall 95 is slid upward so that the lowermost end of the elongated hole 94 abuts the pin 93. An inner edge 95*a* of the lowermost end of the guide wall 95 facing the body 91 has been rounded off to allow clockwise rotation when the lower end of the hole 94 reaches the pin 93. Thus, the guide wall 95 can be turned outward just at a right angle and be held in the position by engagement of the lower end thereof to the bottom of the groove 92, as shown by chain lines in FIG. 11B. As a result, the projected portion of the guide wall 95 is eliminated, making the apron easily replaceable.

As stated above, according to the first aspect of the present invention, the tenser can easily be mounted or dismounted, allowing replacement of an apron can be completed in a shorter time.

Further, according to the second aspect, as the guide wall can be displaced relative to the body of the tenser, the apron can be replaced without being obstructed by the projected portion of the tenser, while the tenser is fixed to the stand.

Thus, the machine stoppage time for a spinning frame is drastically decreased and the resultant yarn quality is improved.

We claim:

1. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means permitting movement of said guide wall member relative to said body, to said apron removal position wherein said apron may be removed from or installed on the free end of said tensioning device.

2. A tensioning device according to claim 1, wherein said connecting means is a combination of a protrusion projected in the lateral direction and a bore receiving the protrusion, each being provided at either of said body or guide wall member of said tensioning device, and said guide wall member is rotatable in a plane parallel to a side surface of said body around the axis of said connecting means from its operative position to a non-operative position.

3. A tensioning device according to claim 1, wherein said connecting means is a combination of a protrusion projected in the lateral direction and a bore receiving the protrusion, each being provided at either of said body or guide wall member of said tensioning device, and said guide wall member is detachable from said body by disengagement of said protrusion from said bore.

4. A tensioning device according to claim 1, wherein said guide wall member is received in a groove provided on a side surface of said body and held therein by engagement of an elongated through-hole of said groove with a pin provided in an upper portron of said groove for bridging inner walls of said groove, whereby said guide wall member is displaceable along said groove and is in said usage position at the lowermost displacement thereof and in said apron removal position at the uppermost displacement where said guide wall is rotatable in a plane perpendicular to a side surface of said body around said pin.

5. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means comprising a key-shaped cylindrical pin extending from said body, and a mating keyhole in said guide wall, said connecting means permitting movement of said guide wall member relative to said body, to said apron removal position wherein said apron may be removed from or installed on the free end of said tensioning device, said pin and keyhole of said connecting means cooperating to permit rotation of said guide wall member relative to said body between said usage position and said apron removal position, said guide wall member being removable from said body when said guide wall member is in the apron removal position thereof.

6. The tensioning device according to claim 5, further comprising spring means disposed within said keyhole for retaining said guide wall in said usage position.

7. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means comprising a shaft extending from said guide wall member, and a hole in said body for rotatably receiving said shaft, said connecting means including spring-loaded detent means mounted on said body and acting on said shaft for permitting removal of said guide wall member from said body, wherein said apron may be removed from or installed on the free end of said tensioning device.

8. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means comprising a hole in said body having a shoulder therein, and a resilient insert attached to said guide wall and extending into said hole so that a portion of the insert abuts said shoulder to prevent lateral movement of said guide wall away from said body, said insert being resiliently deformable upon movement of said guide wall transversely of said free end of said body, to disengage said insert portion from said shoulder so that said guide wall member can be removed from said body.

9. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means comprising (i) a cylindrical projection extending from said body, said projection comprising a stem having a free end, and two parallel flat surfaces on opposite sides of the stem, said flat surfaces ending at a tip portion of the stem adjacent the free end thereof, and (ii) an elongated through-hole extending along a longitudinal axis of the guide wall, said through-hole having a double-layer structure, with an inner layer having a keyhole configuration and an outer layer having a race track configuration, said layers adjoining each other and having coinciding circular portions and overlapping straight portions, said connecting means preventing rotational movement of said guide wall member relative to said body in said usage position, and permitting movement of said guide wall member relative to said body along the longitudinal axis of the guide wall member, to said apron removal position wherein said apron may be removed from or installed on the free end of said tensioning device by rotating the guide wall member.

10. A tensioning device for tensioning an apron wrapped around a cantilever-mounted bottom roller of a drafting means in a spinning frame, said roller having an outer free end on one side from which said apron may be removed, said tensioning device being adapted to be mounted in juxtaposition with said roller so that said apron may be installed on and removed from said tensioning device on an access side of said tensioning device adjacent the free end of said roller, said tensioning device comprising:

a cantilever-mountable body having an apron-supporting surface and a free end on the access side;

a guide wall member connected to said body at said free end thereof and having a projection for preventing lateral movement of said apron toward said free end of said body when said projection is in a usage position, said guide wall member being movable with respect to said body to move said projection to an apron removal position so as to permit lateral movement of said apron over said free end of said body; and connecting means for mechanically locking said guide wall member to said body to prevent movement of said guide wall member laterally of said body when said projection is in said usage position, said connecting means comprising (i) a transversely extending groove in the free end of said body, with a pin traversing oppositely disposed wall of said groove, and (ii) an elongated hole extending longitudinally of said guide wall member, with said pin extending through said hole to permit longitudinal movement of the guide wall member while preventing lateral movement of the guide wall member in the usage position thereof, said connecting means preventing rotational movement of said guide wall member relative to said body in said usage position, and permitting movement of said guide wall member relative to said body along the longitudinal axis of the guide wall member, by sliding of said pin along said elongated hole, to said apron removal position wherein said apron may be removed from or installed on the free end of said tensioning device by rotating the guide wall member, said guide wall member having a rounded edge portion permitting such rotation by providing clearance with respect to an adjacent surface of said groove in said apron removal position.

* * * * *